US005941638A

United States Patent [19]

Fonseca

[11] Patent Number: 5,941,638

[45] Date of Patent: Aug. 24, 1999

[54] CONVERTIBLE BAG TO A BEACH MAT AND VICEVERSA

[76] Inventor: Ana C. Fonseca, 2208 Bayan Way, Antioch, Calif. 94509

[21] Appl. No.: 09/049,848

[22] Filed: Mar. 27, 1998

[51] Int. Cl.[6] ..... B65D 30/00; A47G 9/06

[52] U.S. Cl. ..... 383/4; 383/6; 5/419

[58] Field of Search ..... 383/4, 6; 5/417, 5/419

[56] References Cited

U.S. PATENT DOCUMENTS

| | | | |
|---|---|---|---|
| 2,659,404 | 11/1953 | Kelsey | 383/4 |
| 4,101,994 | 7/1978 | Hoyt | 383/4 X |
| 4,197,891 | 4/1980 | Comollo . | |
| 4,466,517 | 8/1984 | Spiegelman | 383/4 X |
| 4,600,091 | 7/1986 | McLeod | 383/4 X |
| 5,390,381 | 2/1995 | LaMantia | 383/4 X |

*Primary Examiner*—Jes F. Pascua
*Attorney, Agent, or Firm*—J. Sanchelima

[57] ABSTRACT

A mat that is convertible, when folded, into a bag. The mat includes a cushioned head portion and a larger body portion. The mat has a rectangular shape with two handle loops mounted to the cushioned head portion. A strap is attached at one end to a point on the cushioned head portion. To fold the mat, the first fold is longitudinally and the lateral edges of the cushioned head portion. The next step is to centrally fold the body portion in half thus defining the bottom for the internal cavity of the bag being formed. Next the corners of the folded body portion are folded again defining a triangle. Then, the pointed end of the triangle is brought against the cushioned head portion and the strap is passed around the folded body portion and fastened to it.

6 Claims, 2 Drawing Sheets

CONVERTIBLE BAG TO A BEACH MAT AND VICEVERSA

BACKGROUND OF THE INVENTION

1. Field of the Invention

The present invention relates to a shoulder bag that readily converts to a beach mat.

2. Description of the Related Art

Applicant believes that the closest reference corresponds to U.S. Pat. No. 4,197,891 issued to Comollo in 1980. However, it differs from the present invention because Comollo's patent does not teach a bag with a cavity to store and carry items therein. Comollo's patent discloses a beach mat that can be folded and converted to a shoulder bag.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a mat, such as a beach mat, that can be folded and converted to a shoulder bag.

It is another object of this invention to provide a mat that, when converted to a bag, a user can store and carry objects and personal items.

It is still another object of the present invention to provide a beach mat that has built-in cushioned portions.

It is yet another object of this invention to provide such a mat-bag that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
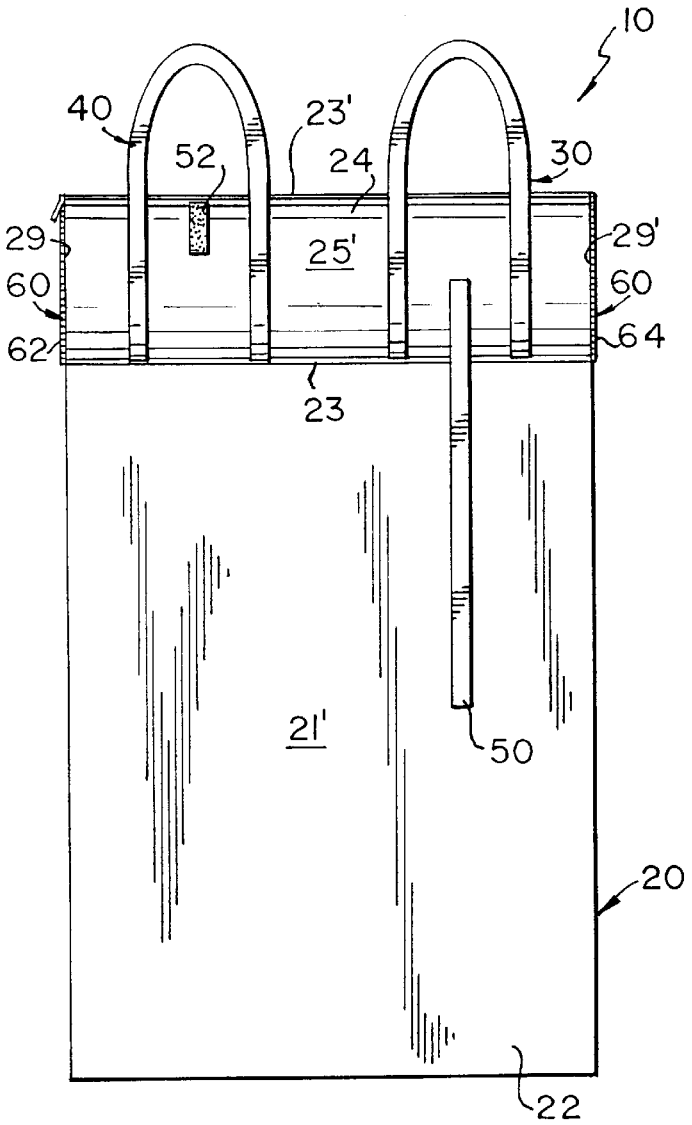
FIG. 1 is a top view of a mat showing the carrying handles and fastening strap.

Referring now to the drawings, where the present invention is generally referred to with numeral 10, it can be observed that it basically includes mat member 20, cushioned head portion 24 with carrying handles 30 and 40, fastening strap 50 and zipper fastener assembly 60.

Figure 1A:
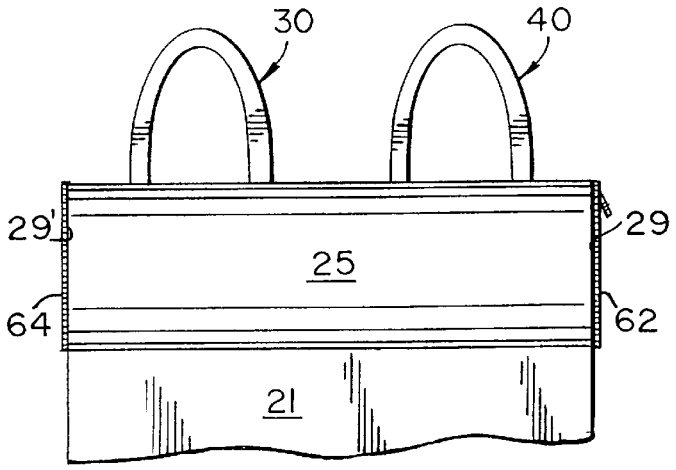
FIG. 1A is a partial bottom view of the mat previously shown.
Figure 3:
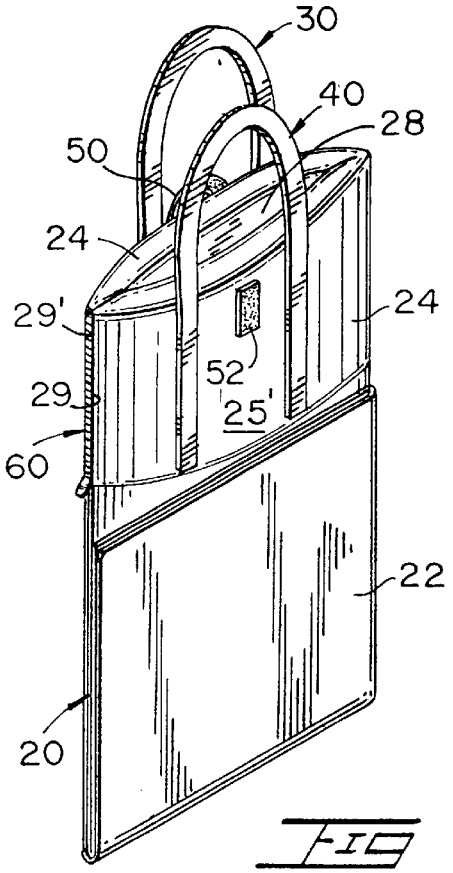
FIG. 3 is an isometric view of this invention showing the mat converting to a bag.

Mat member 20 has substantially rectangular shape, in the preferred embodiment, and includes body portion 22 which is made out of a flexible light weight material, such as clothing or similar material, as best seen in FIG. 1. Mat member 20 includes an inner and outer sides 21 and 21', respectively. FIG. 1 shows outer side 21' while FIG. 1A partially shows the inner side 21 of mat member 20. Carrying handles 30 and 40 are mounted to cushioned head portion 24 on outer side 21'. Fastening strap 50 is sewed, at one end, to outer side 25' of cushioned head portion 24. And the other end of fastening strap 50 includes a Velcro® pad that mates with Velcro® pad 52. Velcro® pad 52, in the preferred embodiment, is located adjacent to outer edge 23' and opposite to internal edge 23 of head cushioned portion 24, and also centrally disposed with respect to handle 40.

Zipper fastener assembly 60 comprises two separate zipper elements 62 and 64 which are mounted to the lateral edges 29 and 29' of cushioned portion 24 of mat 20.

Figure 2:
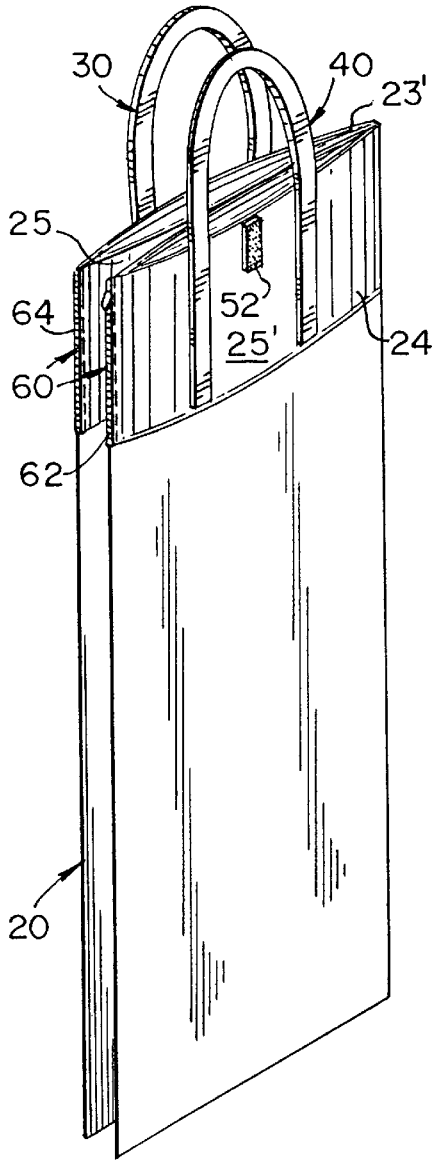
FIG. 2 is an isometric view of this invention shown in the previous figure with the mat portion folded.
Figure 5:
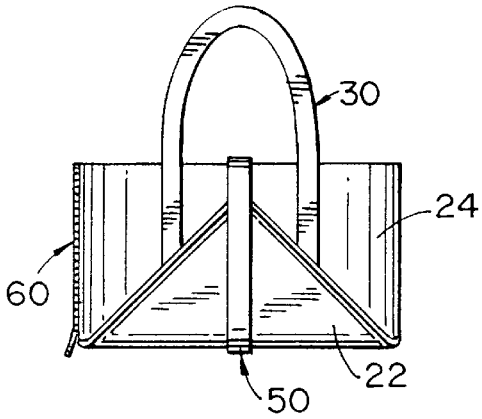
FIG. 5 is an elevational rear view of this invention converted into a shoulder bag.
Figure 4:
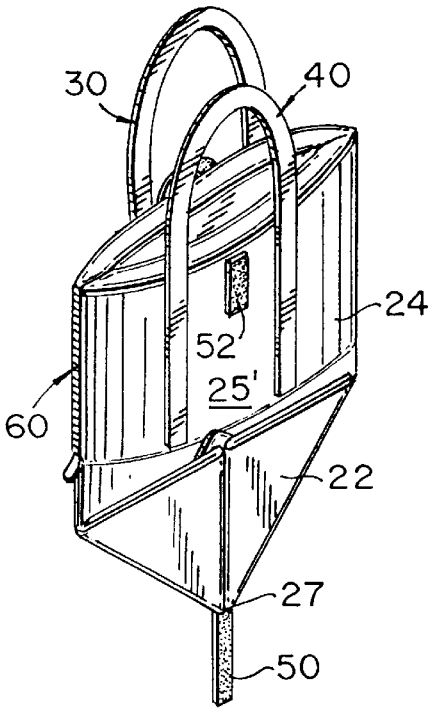
FIG. 4 is an isometric view of this invention showing the folding procedure of the mat.
Figure 6:
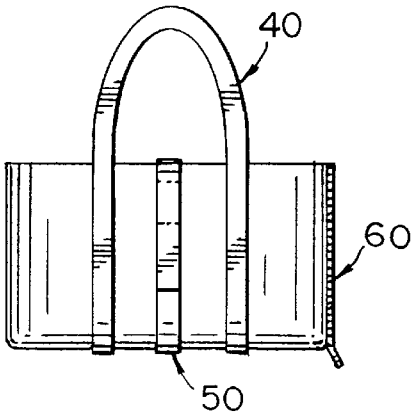
FIG. 6 is an elevational front view of this invention shown in FIG. 5.

Portion 22 and cushioned head portion 24 are designed for a user to lie thereon. Once a user desires to fold mat member 20, she/he folds it longitudinally in two halves exposing carrying handles 30 and 40, as shown in FIG. 2. Zipper fastener assembly 60 is closed bringing the two lateral edges 29 and 29' of portion 24 together. In this manner, inner side 25 of head portion 24 defines the inner walls of cavity 28. Portion 22 is further folded defining the bottom for cavity 28. A triangle is then formed by folding the corners, as best shown in FIG. 4. Fastening strap 50 loops around cushioned portion 24 thereby holding pointed end 27 against pad 52, as illustrated in FIG. 5.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mat, comprising:

A) a head portion having outer and inner sides and a substantially rectangular shape with two lateral edges, an outer edge and an internal edge and said lateral edges including first fastening means to releasably holding them together;

B) a body portion having outer and inner sides and a substantially rectangular shape with two long sides and two short sides, one of said short sides being joined to said internal edge; and C) a strap having two ends, one of said ends being rigidly attached to said head portion and the other end having second fastening means for removably attaching said other end to a point on said head portion on the same side and at a cooperative spaced apart relationship so that when said head and body portions are longitudinally folded, said folded body portion is folded in half, the resulting corners folded to form a triangle and the pointed end of said triangle is brought against said head portion, an aperture is defined by said outer edge with a cavity adjacent thereto.

2. The mat set forth in claim 1 further including:

C) two handles mounted to said head portion.

3. The mat set forth in claim 2 wherein said first fastening means includes a zipper assembly with mating elements on each of said lateral edges.

4. The mat set forth in claim 3 wherein said second fastening means includes at least two pads of mating loop and hook elements cooperatively mounted on said other end of said strap and on said head portion.

5. The mat set forth in claim 4 wherein said head portion is cushioned.

6. The mat set forth in claim 5 wherein said mat is made out of a flexible light weight material.

* * * * *